US005191850A

United States Patent [19]

Gougeon

[11] Patent Number: 5,191,850

[45] Date of Patent: Mar. 9, 1993

[54] SAIL BOAT RIGHTING SYSTEM

[75] Inventor: Jan C. Gougeon, Bay City, Mich.

[73] Assignee: Gougeon Manufacturing Corp., Bay City, Mich.

[21] Appl. No.: 772,146

[22] Filed: Oct. 7, 1991

[51] Int. Cl.[5] ..... B63B 15/00

[52] U.S. Cl. ..... 114/91; 114/123; 114/61; 114/39.1

[58] Field of Search ..... 114/39.1, 90, 93, 91, 114/61, 89, 121, 122, 68, 123

[56] References Cited

U.S. PATENT DOCUMENTS

| | | | |
|---|---|---|---|
| 3,865,061 | 2/1975 | Newman | 114/39.1 |
| 4,223,621 | 9/1980 | Berger | 114/61 |
| 4,227,474 | 10/1980 | Ullrich | 114/61 |
| 4,651,666 | 3/1987 | Lake | 114/39.1 |
| 4,784,075 | 11/1988 | Segger | 114/61 |

*Primary Examiner*—Edwin L. Swinehart
*Attorney, Agent, or Firm*—Learman & McCulloch

[57] ABSTRACT

A righting system for a multi-hulled sailing vessel with a floatable mast has mast support cables, including aft mast support cables, extending from the top portion of the mast to vessel anchor points aft of the mast, and extendable and contractible vessel-anchored tackle systems to connect to them. The righting system includes righting lines which are extendable from each aft mast support cable forwardly to anchors on the hull sides of the vessel substantially forwardly of the connection of the aft stay cable to its vessel anchor points, and a load bearing compression pole which is swivelly connectable to the vessel at the mast and to the one of the aft mast support cables which is out of the water when the vessel is in a side-capsized position in which the tip of the mast is floating in the water.

12 Claims, 5 Drawing Sheets

SAIL BOAT RIGHTING SYSTEM

BACKGROUND OF THE INVENTION

The present invention relates to improvements in righting systems for sail boats and particularly multi-hulled boats, such as catamarans of considerable size and weight. Various righting systems and methods of righting catamarans, once they have capsized onto one of their side hulls, have been proposed and are discussed in the following listed patents, which I incorporate herein by reference.

U.S. Pat. No. 3,865,061: Newman
U.S. Pat. No. 4,223,621: Berger
U.S. Pat. No. 4,227,474: Ullrich
U.S. Pat. No. 4,651,666: Lake As noted in the Newman patent No. 3,865,061, wherein a righting system is proposed for catamarans in the 18 and 22 foot range, all of the righting problems are greatly increased with larger craft which strain and then surpass the capacity of crew members to physically right the boat and mast. The Newman method, for the size sail boats mentioned, lengthens the shroud cable which is out of the water on a side-capsized boat with its mast dragging in the water and effectually moves the hull attachment point of this shroud cable to a position aft of the original attachment point. This movement aft is for the purpose of preventing the mast from tipping or collapsing forwardly, instead of laterally. The weight of crew members standing on the side of the capsized boat opposite the mast side is employed to right boats of the size indicated.

The righting system disclosed herein, unlike the system disclosed in the Newman patent, will enable a single-handed sailor, remaining on the deck side of the boat, to right a 32 foot water ballasted catamaran, weighing in the neighborhood of 2400 pounds and having a floating mast (which prevents its fully inverting or turtling) which may weigh 70 pounds and extend 30 feet upwardly above the cabin top of the boat. The present system does not depend upon the weight of the crew to force the boat back upright, as have so many of the systems proposed in the patents noted. On heavier catamarans of the cruiser type, the angle of the mast has to change relatively more severely to right the capsized boat, because on a larger, heavier boat the crew weight is a much decreased portion of the overall weight of the boat and cannot play much of a role in righting the boat and then raising the mast to a vertical position.

SUMMARY OF THE INVENTION

The method of the present invention utilizes a pole or strut having one end attached to the vessel at the mast and the other detachably attached to the shroud or aft stay cable which is not in the water at the location of expansible and contractible tackle securing the cable to the vessel. Also attached to the shroud or aft stay cable at this point of attachment to the tackle, or near it, is a line which extends forwardly of the mast step and is attached to the vessel low on the exterior side of the out-of-the-water hull. In practice, such a line is installed on each side of the boat to connect to each shroud or aft stay cable. The pole may be separately stowed and attached after the boat has capsized, or may be preattached to the mast or mast step and then swung to a position to attach to the out-of-the-water shroud or aft stay cable at the outset of the righting operation.

As the in-the-water shroud or aft stay cable is effectively shortened by taking up the tackle securing it to the vessel, the hull is angled with respect to the mast in the water, and the forwardly extending line fixed to the out-of-the-water shroud line or cable tautens from a normally slack condition to automatically pull the end of the pole attached to the shroud to a more favorable angle to right the mast during the righting operation. As the tackle for the out-of- the-water shroud line is extended during the righting operation, the forwardly extending line attached to the out-of-the-water shroud line takes a greater and greater share of the load off the shroud cable to in large part support the angled mast as the boat is returned to upright position.

Once the hulls are upright, the mast can be returned to the vertical position easily because the forwardly extending righting line is so much bearing the load that only a relatively light pull on the formerly out-of-the-water shroud tackle line is required, while easing the formerly lower tackle line, to continue to move the mast up to vertical position.

In the present system, at least some tension is maintained on both shroud cables or aft stays throughout the righting operation and, because the cables are attached aft of the mast, the in-the-water-shroud cable holds the mast aft, even though the out-of-the-water shroud cable is effectively elongating.

One of the prime objects of the present invention is to provide a new system and method of self-righting larger catamarans than previously, which can be very easily and efficiently accomplished by one person.

Another object of the invention is to provide a system and method which permits the crew to rapidly right larger catamarans which have sidecapsized and have their masts dragging in the water, so that potentially dangerous exposures to very cold water and heavy seas are minimized, and such larger boats can be operated with greater safety.

Another object of the invention is to provide a relatively simple and very inexpensive righting system for large, and large water-ballasted multi-hulled boats.

Another object of the invention is to provide a system which enables the crew to right the vessel without outside assistance.

Other objects and advantages of the invention will become apparent with reference to the accompanying drawings and the accompanying descriptive matter.

THE DRAWINGS

DETAILED DESCRIPTION OF THE DRAWINGS

Figure 1:
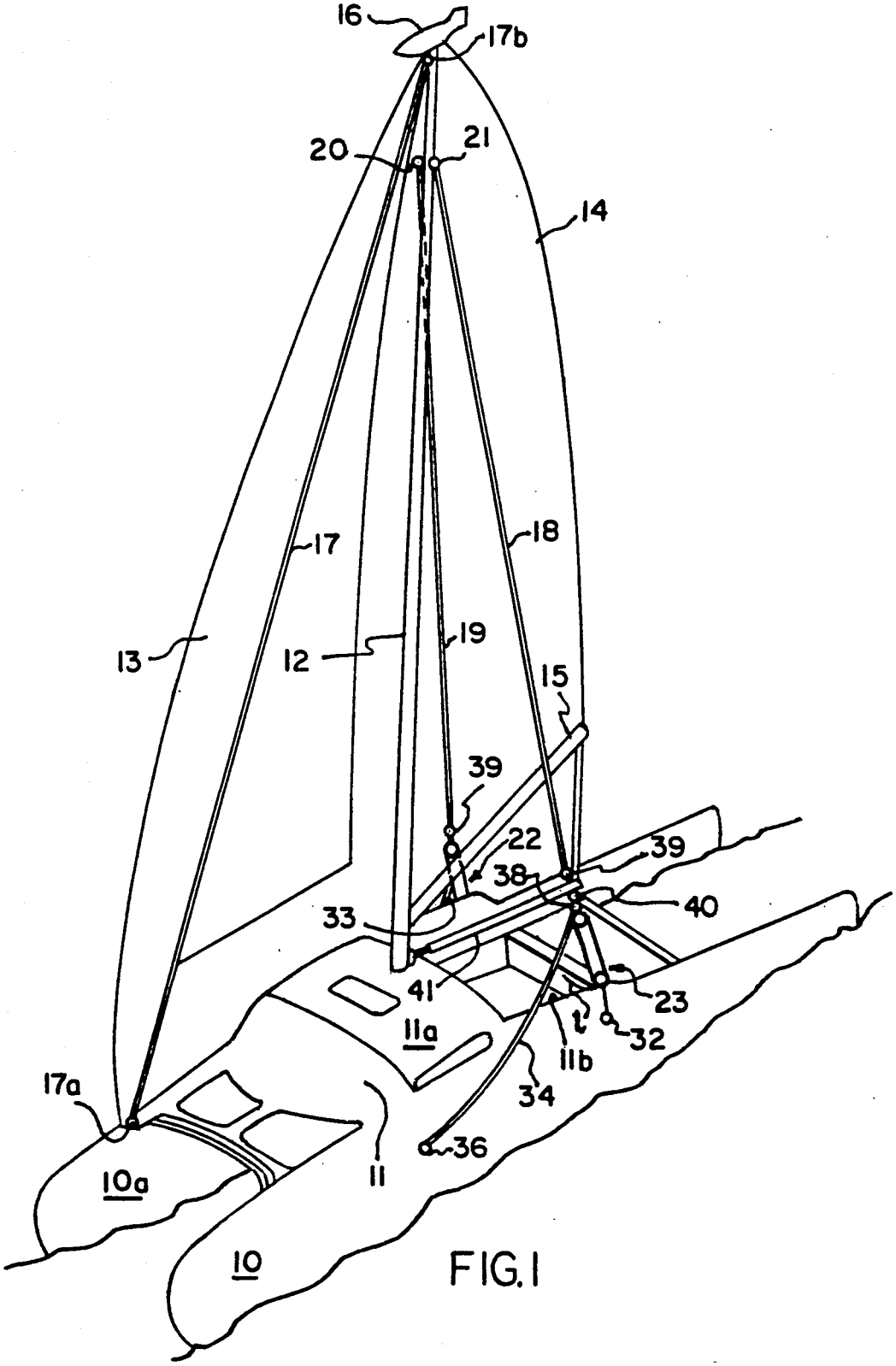
FIG. 1 is a perspective, elevational view of a catamaran which is rigged to permit practice of the righting system.

In FIG. 1, a typical catamaran vessel of the size and weight mentioned is schematically depicted and includes, as usual, a pair of laterally spaced hulls 10 and 10*a* connected by a boat body portion or deck structure 11. As constituted, the deck structure 11 includes a cabin portion 11*a* and a cockpit portion 11*b*. However, the deck structure could take various other configurations.

The sail boat also will have an appropriate tiller-rudder steering device and may have a center board structure. Stepped longitudinally centrally on the deck structure 11, and extending upwardly from the roof of cabin 11*a*, is the universally mounted mast 12 which can move from the vertical position in which it is shown in FIG. 1 to a longitudinally aft to fore lowered position to enable ready transport of the vessel over the highway. In this connection, the beam of the boat may typically be 8'6", such that it is readily transportable on a trailer to and from loading and unloading ramps and sailing locations. The boat, however, is sufficiently large as to be usable as a cruiser, and may provide sleeping and other living accommodations in the cabin 11*a*.

A fore sail 13 may be connected to the vessel and to the mast in any suitable manner, as is a main sail 14 which is connected to both the mast 12 and a boom 15. The boom 15 is swung or manipulated by the sailor, using boom tackle in the usual manner. At its upper end, the mast 10 carries a torpedo or zeppelin shaped float 16 having sufficient buoyancy to support the weight of mast 12 when the boat is in a side-capsized position and the mast 12 is dragging in the water. Float 16 prevents the boat from turtling.

Figure 8:
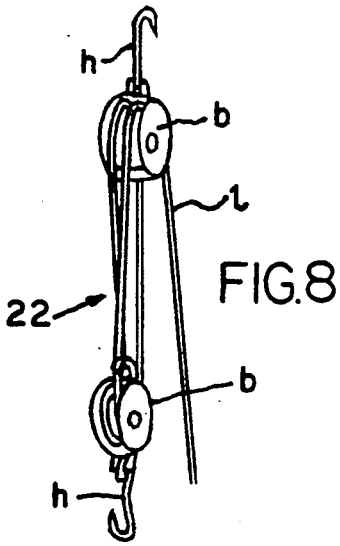
FIG. 8 is a side elevational view of a typical tackle system.
Figure 6:
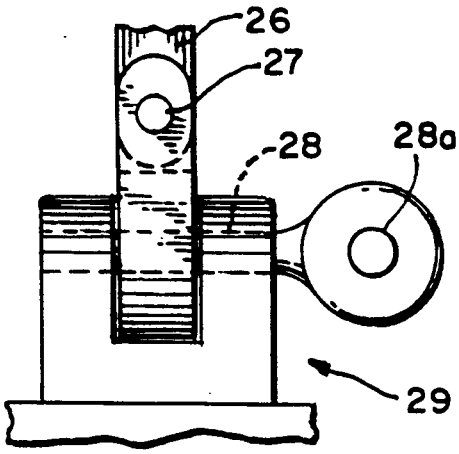
FIG. 6 is an side elevational view thereof.

The mast 12 is supported in an upright position by a fore stay 17 connected to the vessel at 17*a* and to the mast 12 near its upper end at 17*b*. Also provided at each side of the vessel are a pair of aft stay or shroud cables 18 and 19. These stays 18 and 19 respectively connect to the mast at 20 and 21 and include, at their lower ends, expansible and contractible tackle systems of conventional character such as shown at 22 and 23. It is to be understood that the term "cable" is to be interpreted as including a line of textile fabrication and need not be metallic in character. In FIG. 8, a typical tackle system is illustrated. It includes blocks b and a line l. The tackle system employed typically provides a six to one, or better, mechanical advantage, with the blocks b attached to the vessel and to the aft stay cables, of which they form a part S by hooks h secured to shackles. The lines l of tackle systems 22 and 23 are typically releasably secured to the vessel by conventional cam cleats.

At its lower end, the mast 12 is tapered, as shown at 12*a*, and received within a socket 12*b* provided in one upper part 24 of a universal stepping joint, generally designated 25. The lower part 26 of the universal joint 25 comprises a yoke whose legs are joined by a pin 27 which pivotally supports the yoke 24. An oppositely extending pin 28 carried by a universal joint base 29 extends at right angles to pin 27 to pivotally support the yoke 26. Pin 28 can take the form of an eye bolt which includes an eye 28*a*. The conventional tackle devices or systems 22 and 23 are connected to the hulls of the vessel at points 31 and 32 aft of the mast 12, and a pair of port and starboard lines 33 and 34, which also connect to the aft stay lines, connect to the sides of the hull members 10 and 10*a* forwardly of the mast 12 at 35 and 36 respectively. The lines 32 and 34 extend to fixedly connect to the starboard and port aft stays at points 37 and 38, as shown. Finally, provided on the starboard and port aft stays 19 and 18 respectively are a pair of fixed vertically spaced stop or pole retainer members 39 and 40.

Figure 7:
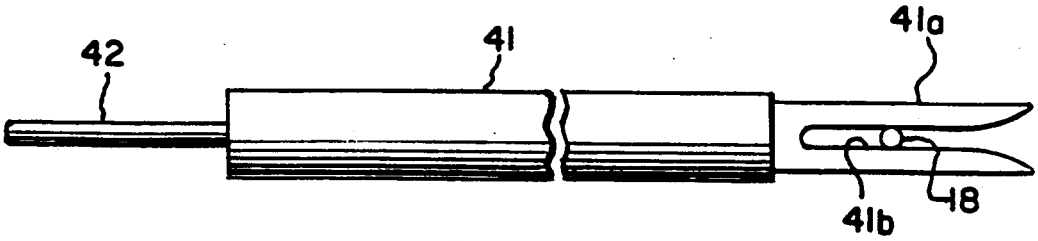
FIG. 7 is a top plan view of the righting strut.

As will become apparent, a rigid, preferably wood pole or strut 41, which may be separately stowed aboard, is releasably connected to the vessel at the mast, and to the appropriate aft stay 17 or 18 as may be required, when a righting needs to be accomplished. The pole 41 which is of larger diameter than the opening through eye 28*a*, has an extending spike 42 which passes through and is received within the eye 28*a*. At its opposite end, strut 41*a* has a claw end which is grooved as at 41*b* to receive either of the aft stays 18 or 19 as shown in FIG. 7. The width of groove 41*b* is such that it will not pass stops 39 and 40.

THE OPERATION OF THE SYSTEM

Figure 2:
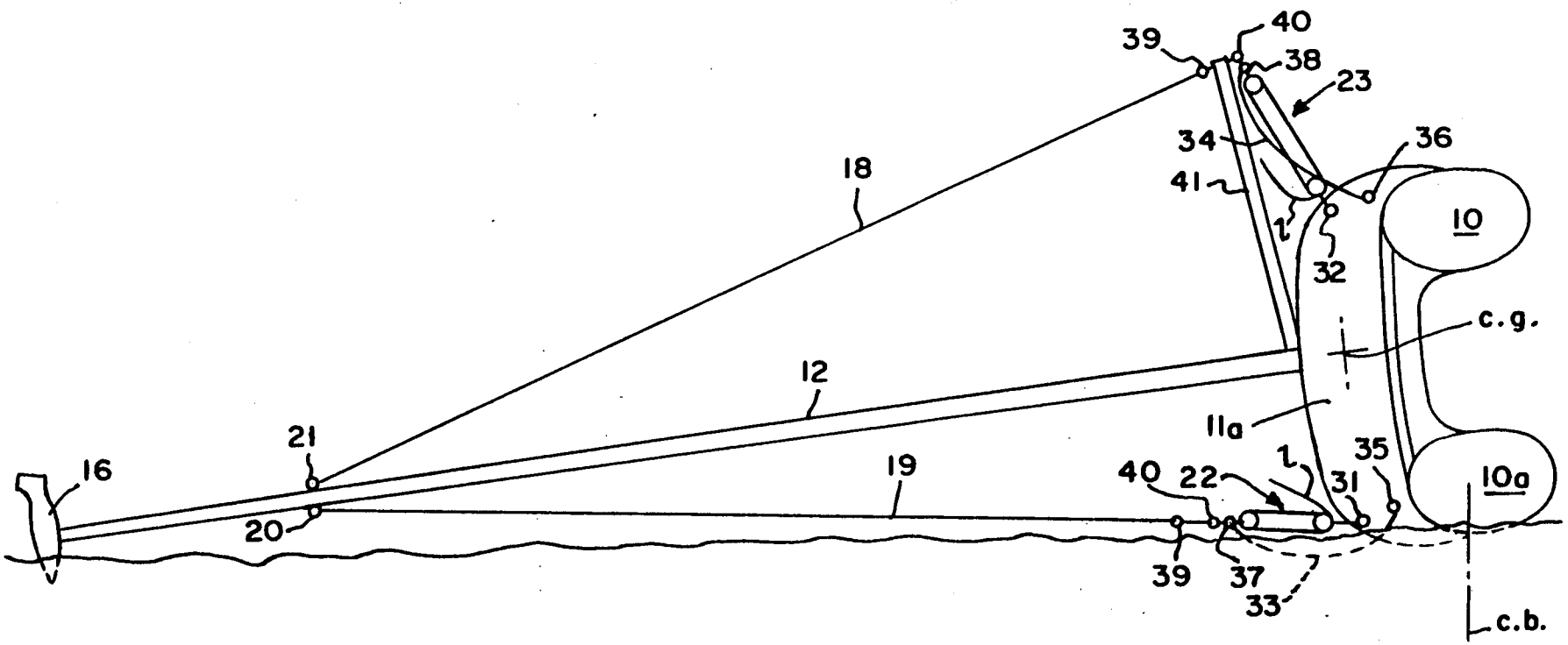
FIG. 2 is a schematic, front elevational view showing the boat in a side-capsized position with the righting pole attached and in position.
Figure 3:
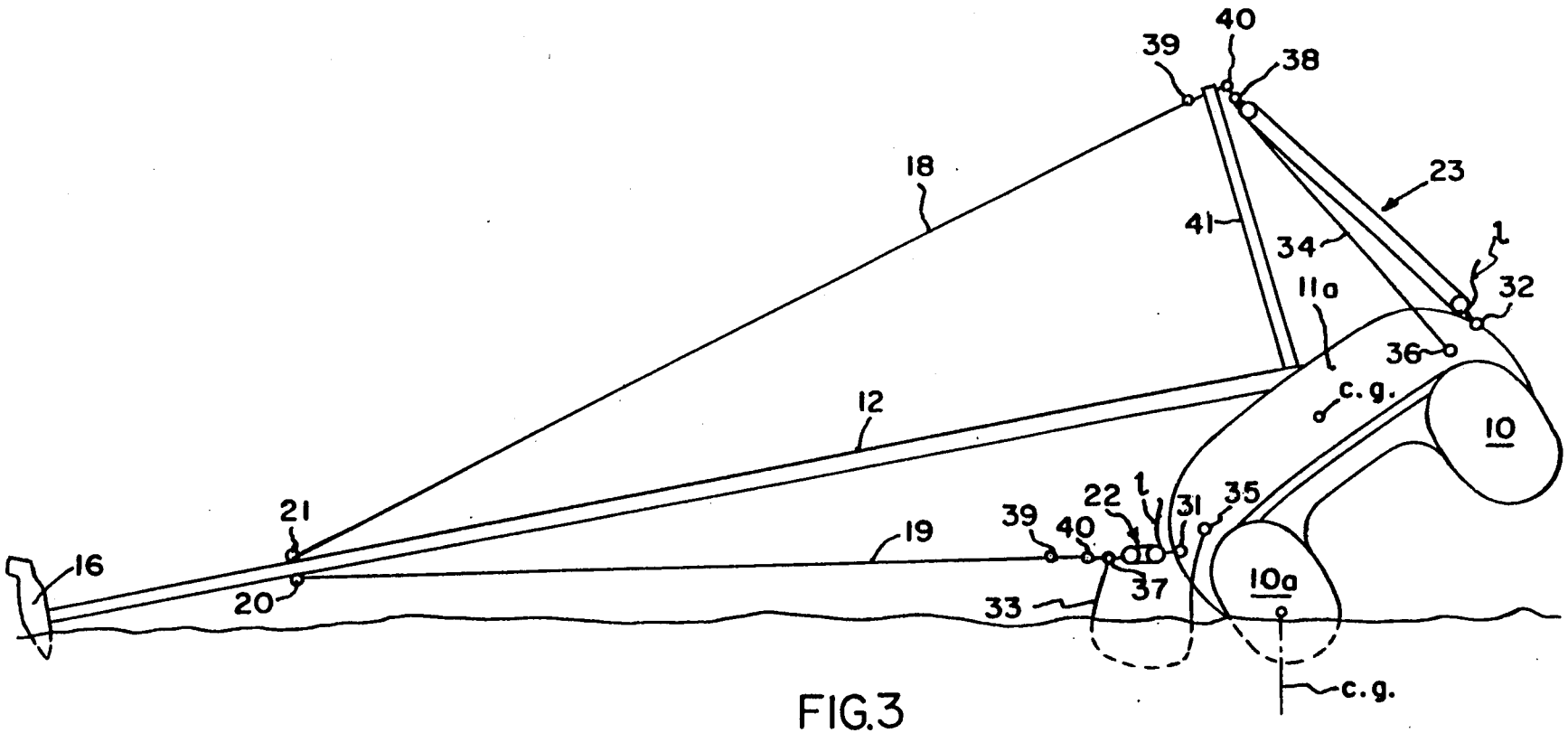
FIG. 3 is a similar schematic view showing the elements in still a further advanced position during the righting operation, with the hull now having swung to position in which its weight will right the boat.

In FIG. 2 the boat is shown as in the side-capsized position wherein the hull of the boat is keeled over to a position beyond 90° and the mast float 16 is in the water and floating to support the weight of the mast 12 and prevent the vessel from turtling. The center of gravity e.g. of the boat is offset over center from the center of buoyancy c.b. of the hull.

One person standing in the cockpit area can mount the strut or pole 41 in position by inserting its claw end over the out-of-the-water mast support cable 18 to receive the cable 18 in the groove 41*b* between the stops 39 and 40, and then jabbing the pin end 42 of the strut into the eye 28*a* provided on the mast step pivot pin 28. Initially, the person will pull on the in-the-water-tackle system (which is shown a tackle system 22 for purposes of illustration) to progressively decrease the effective length of the aft mast support cable 19 in the water and tension the upper aft mast support cable 18, and while, to a lesser degree, laying off the tackle system 23 for the out-of-the-water mast support cable 18 to permit its effective length to increase. The tautening of the in-the-water-mast support cable 19 will initially tension cable 18 to cause the hull to tend to pivot in a clockwise direction and move back toward vertical position. This happens with the mast 12 remaining in the same position, the hull simply pivoting with respect to the base end of the mast. With smaller boats, such a prior art system which does not employ righting lines or a compression pole has been sufficient. It will not work with larger heavier boats. With the present system, as the hull continues to swing toward vertical position, the forwardly extending out-of-the-water line 34 tautens and is tensioned to take some of the load from the out-of-the-water tackle system 23, and this tends to force the upper end of pole 41 to begin to pivot or swing in an upward and forward direction. As the outer end of pole 41 swings upwardly and forwardly it holds the out-of-the-water shroud line 18 and tackle system 23 still further away from the mast 12 to permit the exertion of greater leverage on the floating remote end of the mast. Also, as the line 34 becomes more aligned with the out-of-the-water shroud line 18, it takes more and more of the load. When the hull moves through the vertical position and the center of gravity c.g. moves over beyond the center of buoyancy c.b., the weight of the ballasted hull 10, of course, tends to assist the righting operation.

Figure 4:
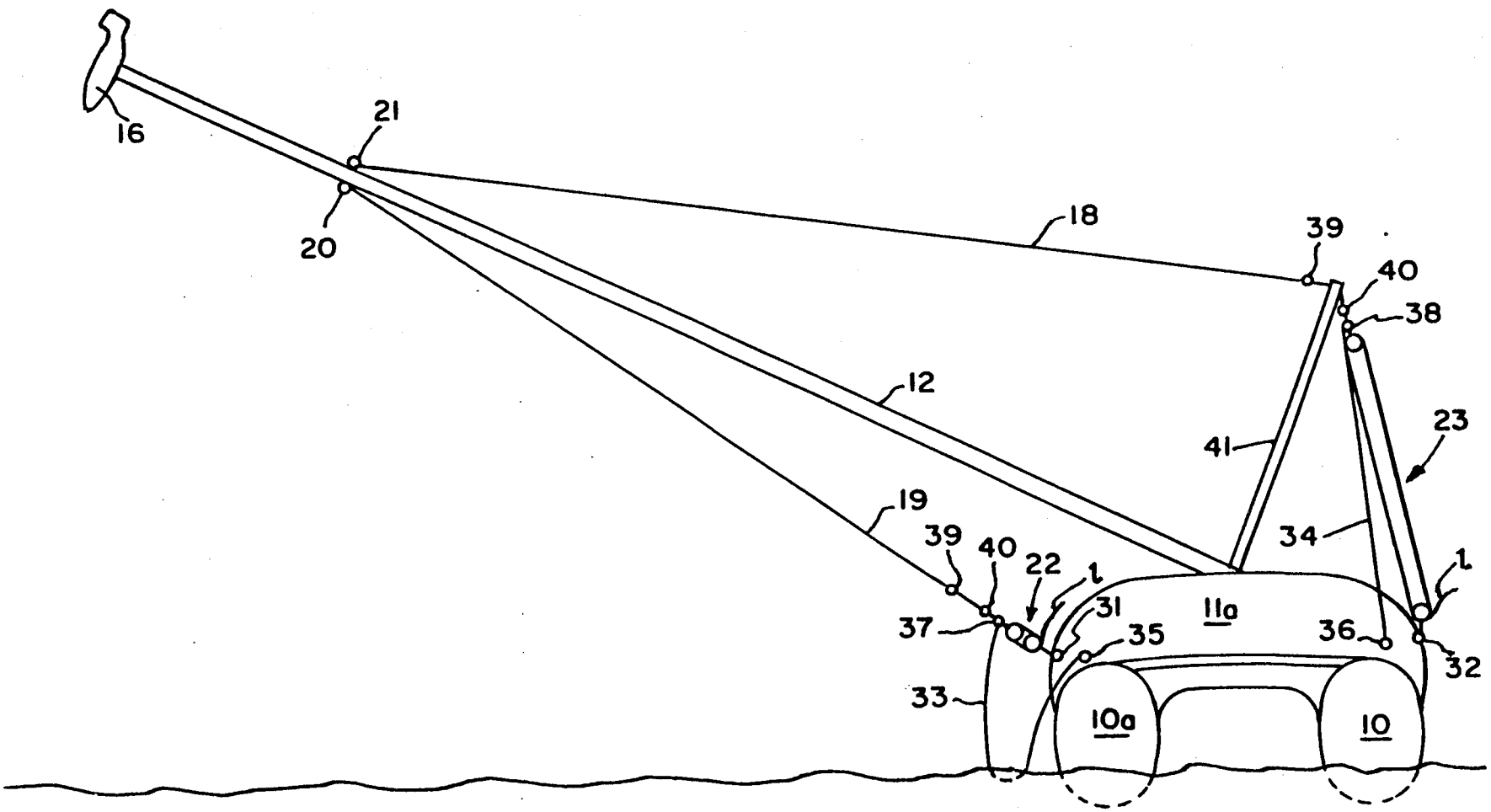
FIG. 4 is a similar schematic front elevational view illustrating the hull in a righted position, the mast being shown as pulled upwardly out of the water to a position in which complete righting of the mast can be readily effected.
Figure 5:
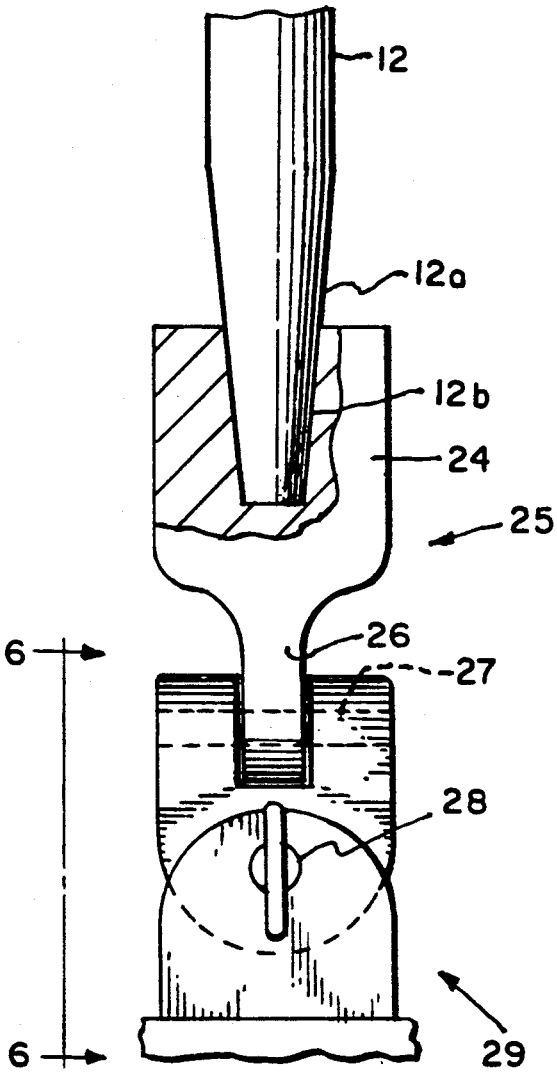
FIG. 5 is an enlarged, fragmentary elevational view of a typical universal mast step.

When the hull 10 has swung over sufficiently, it begins to lift the outer end of mast 12 out of the water. At this time, the pole 41 has reached a substantially lateral position in which it is almost perpendicular to the fore and aft longitudinal center line of the vessel, and the line 34 has taken approximately 75% of the load off the out-of-the-water tackle system 23. The pole 41 then maintains the out-of-the-water mast support cable 18 in the most favorable angular position for further pulling the mast out of the water. When the hulls reach a restored or righted position, the mast will still be at an inclined angle (as shown in FIG. 4) and, to fully right the mast, the formerly out-of-the-water tackle system 23 is contracted while the formerly in-the-water-tackle system 22 is laid off to bring the mast to the fully upright system. Because the line 34 is, at this time, supporting 75% of the load, and the pole 41 is maintaining the favorable angle of the mast support line 18 with respect to the mast, a greatly decreased pull on the formerly out-of-the-water tackle system 23 will effect the final mast-righting movement. The pole 41 also keeps the line 34 from wrapping around the hull. Because the pole 41 connects to the mast step via eye 28*a*, the compression load transmitted by the pole or lever 41 is borne by the vessel and not the mast.

The result of the load sharing which occurs is that the pull required on the tackle systems by the person exerting the pull on the tackle systems can be generally uniform throughout the mast raising operation, and relatively light.

It is to be understood that the embodiments described are exemplary of various forms of the invention only and that the invention is defined in the appended claims which contemplate various modifications within the spirit and scope of the invention.

I claim:

1. A relatively large, multi-hulled sailing vessel having a bow and stern, which is easily self-righted without outside assistance comprising:

a. at least first and second parallel hulls joined by a connecting boat portion;

b. a floatable mast with a lower end tiltably laterally centrally mounted on said connecting boat portion;

c. an aft stay system including a pair of mast supporting aft stay cables connected to the mast at their upper ends and to the vessel at their lower ends on opposite sides of the vessel aft of the mast to normally tend to prevent forward and lateral tipping of the mast;

d. a stay cable system connected to the mast and connected also to the bow of the vessel to tend to normally prevent rearward tipping of the mast;

e. a boom for the mast for a sail assembled to the boom and mast;

f. a generally compression load bearing pole swivelly connectable to the vessel at the mast and extending to releasably connect to one of said aft stay cables and hold it out away from said mast;

g. a righting line connectable to said one of said aft stay cables near the connection of the pole to said one of said aft stay cables and connectable to the side of the vessel forwardly of the connection of said one aft stay cable to said vessel; and h. a mechanical advantage exerting tackle system connectable to said other of said aft stay cables and to said vessel for effectively tautening the said other aft stay cable and imposing a load on said one aft stay cable which is transmitted in part to said righting line.

2. The vessel of claim 1 wherein a second righting line is connected to the other of said aft stay cables and extends forwardly to connect to the side of the vessel substantially forwardly of the connection of said other aft stay cable, and a mechanical advantage exerting tackle system is connectable to said one aft stay cable and to said vessel.

3. The vessel of claim 2 wherein each of said aft stay cables has a connection for receiving the outer end of said pole.

4. The vessel of claim 3 wherein said pole is a rigid lever having an open ended slot in its outer end for receiving one of said aft stay cables, and a pair of spaced apart stops on said aft stay cables of larger cross section than said slot prevent undue displacement of the pole on the aft stay cable on which it is received when the pole outer end is received between them.

5. The vessel of claim 4 wherein said righting lines attach to said aft stay cables below said stops.

6. The vessel of claim 5 wherein one of said mechanical advantage exerting tackle systems forms a part of each aft stay cable below said stops and connects each aft stay cable to said vessel.

7. The vessel of claim 6 wherein said righting lines connect to the bow portions of said hulls on the laterally exterior sides thereof.

8. The vessel of claim 7 wherein said righting lines are normally slacked when the vessel is in upright sailing position.

9. A method of righting a relatively large multi-hulled sailing vessel defined by buoyant hulls with bow and stern ends, and an amidships portion on which a floatable mast is universally tiltably mounted by a mast step, from a side capsized position in which the tip of the mast is floating in the water and one of the hulls is floating on its side in the water while the other is above it out of the water, the mast being normally supported by a fore stay and first and second mast support cables extending from the top portion of the mast to vessel anchor points aft and laterally outwardly of the mast which have lengthwisely extendible and contractible first and second tackle systems respectively connectable to them for increasing the mechanical advantage of a pull exerted on the aft mast support cables, there also being first and second righting lines extendable from each aft mast support cable and leading forwardly to anchor locations on the hull sides substantially forwardly of the mast step, the second aft mast support cable and the second righting line being substantially in the water, and the first aft support cable and the first righting line being substantially out of the water, when the vessel is side-capsized, comprising the steps of:

a. affixing a load bearing compression pole, which is pivotally connectable to the vessel at the mast, to said first aft mast support cable near the connection of the said first righting line;

b. tautening the said second mast support cable to exert a force tending to cause the lower end of the vessel to pivot with respect to the mast and move to a more upright position while holding said first aft mast support cable outwardly away from the mast step with the pole and causing said first righting line to tauten and bear a substantive properties of the load;

c. continuing to tauten said second aft mast support cable by contracting said second tackle system in length while easing off on said first tackle system;

d. in tautening said first righting line, swinging the end of the pole attached to said first aft support cable upwardly and imposing a greater proportion of the load on said first righting line as the hull continues to swing toward righted position; and e. in the upright position of thehull, tautening said first tackle system and laying off said second tackle system to further right the mast, while holding the said first aft mast support cable outwardly away from the mast step with the pole.

10. The method of claim 9 in which said righting lines are normally slacked.

11. The method of claim 9 in which said pole connects to the mast step to impose its load thereon.

12. The method of claim 9 wherein an eye having an opening of reduced diameter relative to said pole is provided on said mast step and said pole has an open ended slot in one end and a reduced diameter extension on its other, and said pole is affixed by sliding it laterally to receive said first aft stay cable within the slot while inserting the extension through said eye on the mast step.

* * * * *